US007635130B2

(12) United States Patent
Dobrindt

(10) Patent No.: US 7,635,130 B2
(45) Date of Patent: Dec. 22, 2009

(54) DEVICE FOR PLACING SHEETS FOR A PRINTER

(75) Inventor: Dirk Dobrindt, Klausdorf/Schwentine (DE)

(73) Assignee: Eastman Kodak Company, Rochester, NY (US)

( * ) Notice: Subject to any disclaimer, the term of this patent is extended or adjusted under 35 U.S.C. 154(b) by 380 days.

(21) Appl. No.: 10/569,170

(22) PCT Filed: Aug. 20, 2004

(86) PCT No.: PCT/US2004/027227

§ 371 (c)(1),
(2), (4) Date: Sep. 25, 2006

(87) PCT Pub. No.: WO2005/019078

PCT Pub. Date: Mar. 3, 2005

(65) Prior Publication Data

US 2008/0036136 A1 Feb. 14, 2008

(30) Foreign Application Priority Data

Aug. 22, 2003 (DE) ..... 103 38 598

(51) Int. Cl.
*B65H 29/20* (2006.01)

(52) U.S. Cl. ..... 271/315; 271/220; 271/187

(58) Field of Classification Search ..... 271/153, 271/154, 214, 185, 186, 177, 178, 187, 314, 271/315, 82, 155, 217, 215, 3.17, 220; 414/793.9, 414/794, 198, 441, 459.2
See application file for complete search history.

(56) References Cited

U.S. PATENT DOCUMENTS

| | | | | | |
|---|---|---|---|---|---|
| 4,212,456 | A | * | 7/1980 | Ruenzi | 271/4.04 |
| 4,501,418 | A | * | 2/1985 | Ariga et al. | 271/187 |
| 4,552,351 | A | * | 11/1985 | Tsukamoto | 271/315 |
| 5,098,080 | A | * | 3/1992 | Arnone et al. | 271/187 |
| 5,114,135 | A | * | 5/1992 | Evangelista et al. | 271/187 |
| 5,145,167 | A | * | 9/1992 | McGraw et al. | 271/186 |
| 5,409,201 | A | * | 4/1995 | Kramer | 270/58.13 |
| 5,409,202 | A | * | 4/1995 | Naramore et al. | 270/58.12 |
| 5,518,230 | A | * | 5/1996 | Scarlata et al. | 271/186 |
| 5,639,080 | A | * | 6/1997 | Evans | 270/58.28 |
| 5,685,532 | A | * | 11/1997 | Amarakoon | 270/58.07 |
| 5,803,705 | A | * | 9/1998 | Keyes | 414/793.9 |
| 5,899,448 | A | * | 5/1999 | Hosking | 271/3.08 |

FOREIGN PATENT DOCUMENTS

| | | |
|---|---|---|
| EP | 1 219 557 A2 | 7/2002 |
| EP | 1 318 094 A2 | 6/2003 |
| GB | 2 082 551 | 3/1982 |
| JP | 2001288525 | 10/2001 |

* cited by examiner

*Primary Examiner*—Patrick H Mackey
*Assistant Examiner*—Jeremy Severson
(74) *Attorney, Agent, or Firm*—Peyton C. Watkins

(57) ABSTRACT

At least two sheet conveyors are provided in such a way that several of these conveyors can rotate around the common axis, essentially independent of one another, and thus one of these sheet conveyors is ready to accept or detect the next sheet, if another of these sheet conveyors is still occupied with the transport or the placement of a preceding sheet and that a sensor is coupled mechanically with several of these sheet conveyors.

14 Claims, 8 Drawing Sheets

DEVICE FOR PLACING SHEETS FOR A PRINTER

FIELD OF THE INVENTION

The invention concerns a device for placing sheets for a printer, preferably, for an electrophotographic printer, including at least one rotating, drivable sheet conveyor, which is provided to take up or grip a front edge of a sheet and to place the sheet after traversing a rotation path. A sensor device detects the attained stack height or the attained stack level, and has, at the same time, a sensor. The sensor simultaneously functions as a holding-down element for the stack, which is lifted, mechanically controlled, from the stack for the release of the stack, so as to place the next sheet on the stack.

BACKGROUND OF THE INVENTION

A device for placing sheets on a stack is known from U.S. Pat. No. 5,518,230. There, on a rotating drivable sheet stack disk, which has two slits as sheet holders, arranged diametrically opposite one another, a sensor of a stack level sensor is coordinated with the rotating position of the sheet stack disk, mechanically controlled by an eccentric plate, in order to lift the sensor from the stack, automatically and mechanically controlled, for the release of stack, so as to place the next sheet on the stack. The sheet conveyor, known from the cited prior art, has two slits, diametrically opposed to one another, to accept the front edges of the sheets, so that already, the sheet conveyor is ready, in principle, once more, to take up the next sheet, while it places a preceding sheet.

In reality, this applies, however, only if the sheets to be taken over have a suitable format. A sheet is namely passed on to the conveyor, preferably by transport rollers on the end of a transport path for stock. A good placement of the sheet is attained, in particular, if the transport rollers release the back edge of the sheet just as the front edge of the sheet reaches a stop on a release site, because then the sheet is pliantly placed on a sheet stack. This means that the sheet should have a length with which it wraps around the sheet conveyor by just approximately half, that is, corresponding to approximately half the circumference of the jacket surface of the sheet conveyor. This is, by no means, always the case, however. Longer or shorter formats are also transported. Anyway, heavier and stiffer stock, for example, cannot be bent very much, free of damage, so that as a precaution with respect to such stock, the radius of the sheet conveyor is selected larger, rather, than would be suitable perhaps for the length of the sheet format. On the other hand, however, a uniform flow of sheets, if possible, should be transported for the utilization of the device, in which there will not arise an excessively large gap between successive sheets. However, successive sheets should not overlap either.

Thus, it may be that the free slit, which should carry out the next takeover, could be ready either too early or too late, depending on the situation. In view of the described situation, this problem would not be solved either by equipping the sheet conveyor with a larger number of slits (or with otherwise jaw-like holders).

SUMMARY OF THE INVENTION

The goal of the invention, therefore, is to provide a reliable apparatus for stacking sheets, even with a more optimal loading of the sheet conveyance.

This goal is attained, in accordance with the invention, in that at least two sheet conveyors are provided, in such a way, that several of these sheet conveyors are rotatable, essentially independent of one another, around a common axis. Thus one of these sheet conveyors is ready to accept or grip the next sheet, if another of these sheet conveyors is still occupied with the transport or placement of a preceding sheet, and that a sensor is mechanically coupled with several of these sheet conveyors.

The solution, in accordance with the invention, advantageously makes available optimization possibilities for the loading and quick speed of the sheet conveyance, because the other or another sheet conveyor can be made ready, independently and in a timely manner, adapted to the format of the sheet, the speed of the sheets, and its own transport speed, wherein at the same time, the stack level can be simultaneously and reliably detected after every sheet placement.

The next refinement of the invention provides for the provision of a sheet guide, which operates together with the sheet conveyor, wherein the sheet guide with a jacket surface, which serves as a placement for the sheet, essentially specifies a curvature path for the sheet to be conveyed and each sheet conveyor has at least one gripping element to grip the accepted front edge of the sheet, in such a way, that the front edge of the sheet can be gripped and conveyed between one of these gripping elements of a sheet conveyor and the jacket surface of the sheet guide, and wherein the sensor is mechanically coupled with all the sheet conveyors and/or with the sheet guide.

With the device, in accordance with the invention, functions can thus be advantageously distributed among various elements so that a functionality, which is all the more purposeful and reliable is attained. The sheet guide essentially takes over the disk body function and offers a layout and a placement for the sheet, wherein this guide need not be absolutely the shape of a disk either, but rather, in accordance with a refinement can be segmented in the shape of a wheel also, or in another manner.

The sheet conveyors take over, above all, a part of the holding function, in that a sheet conveyor makes available a gripping element, which clamps the front edge of the sheet between itself and the jacket surface of the adjacent sheet guide and in this way holds it secure, without damaging the front edge. The participating sheet conveyor, therefore, need not have the shape of a disk, but rather can preferably be, in accordance with a refinement of the invention, constructed essentially as a two-arm swivel beam, which has a gripping element in the area of its two free ends which point radially outwards. By the gripping elements on both ends, each sheet conveyor is already available to grip the next sheet while it places a preceding sheet, or at least shortly afterwards. The sheet guide, which is, anyway, preferably and essentially rotation-symmetrical, is, in principle and in any case, ready in any rotation position and at all times.

The gripping element is preferably flat, as a tongue or flap, and optionally, in such a manner that it yields elastically, so that damage to the front edge of the sheet is avoided. The gripping element is, preferably and essentially, a tongue or flap, following, approximately parallel, the curvature path of the guiding element. The sensor is connected with all sheet conveyors and/or with the sheet guide so that it is adapted, controlled by this, to the operating course of the sheet conveyor, without hindering it.

In accordance with a further refinement of the invention, the device includes several of these sheet conveyors, and the guides are doubly provided and are arranged on the common axis, with a mirror symmetry with respect to one another, in such a way that all sheet conveyors are arranged between the two sheet guides, so that a front edge of the sheet, in its course parallel to the common axis of the sheet conveyors and the sheet guides, can be jointly gripped by two of the, all total, at least four sheet conveyors and the two sheet guides.

In this manner, the sheet is advantageously and reliably gripped over its entire width and in particular, an inclined position or a twisting by the transport is prevented. Here, the sensor can also be coupled, in a controlled manner, without being a hindrance. Preferably, provision is made so that the sensor is coupled with several sheet conveyors by means of guide links. The sensor can have at least one bearing arm, which supports at least one roller element, rolling and guided on a guide link.

An independent solution, in accordance with the invention, has several sensors, placed, distributed, over the stack width, all of which are coupled mechanically with at least one sheet conveyor. In this way, it is also possible to detect advantageously a non-horizontally oriented stack level, in a reliable and precise manner, and to recognize an inclined position of the stack in time to take countermeasures.

Advantageously, provision is made so that three sensors are present, of which one is placed in the middle of the stack and the other two, at a distance from one and the other side of the middle sensor. However, a more finely segmented sensing device with a larger number of sensors can also be provided, in order to be able to detect the stack level and position more precisely.

Another refinement of the device, in accordance with the invention, provides for at least one sensor element to be present for the detection of the level position of at least one sensor. This sensor element is preferably a light barrier, preferably, a forked light barrier.

It should be possible to recognize advantageously three marked level positions of the sensor with the sensor element, namely and preferably, the lifted position, the stack zero position, and the lowest stack position of the sensor. This can be attained advantageously in that the marked level positions are recognizable by a switch flag, coupled with the sensor, for example, by transparent perforations of the switch flag at the correlated sites.

BRIEF DESCRIPTION OF THE DRAWINGS

An exemplified embodiment of the device, in accordance with the invention, from which it is possible to deduce other inventive features, but to which the invention is not restricted in its scope is shown in the drawing. The figures show the following.

DETAILED DESCRIPTION OF THE INVENTION

Figure 1:
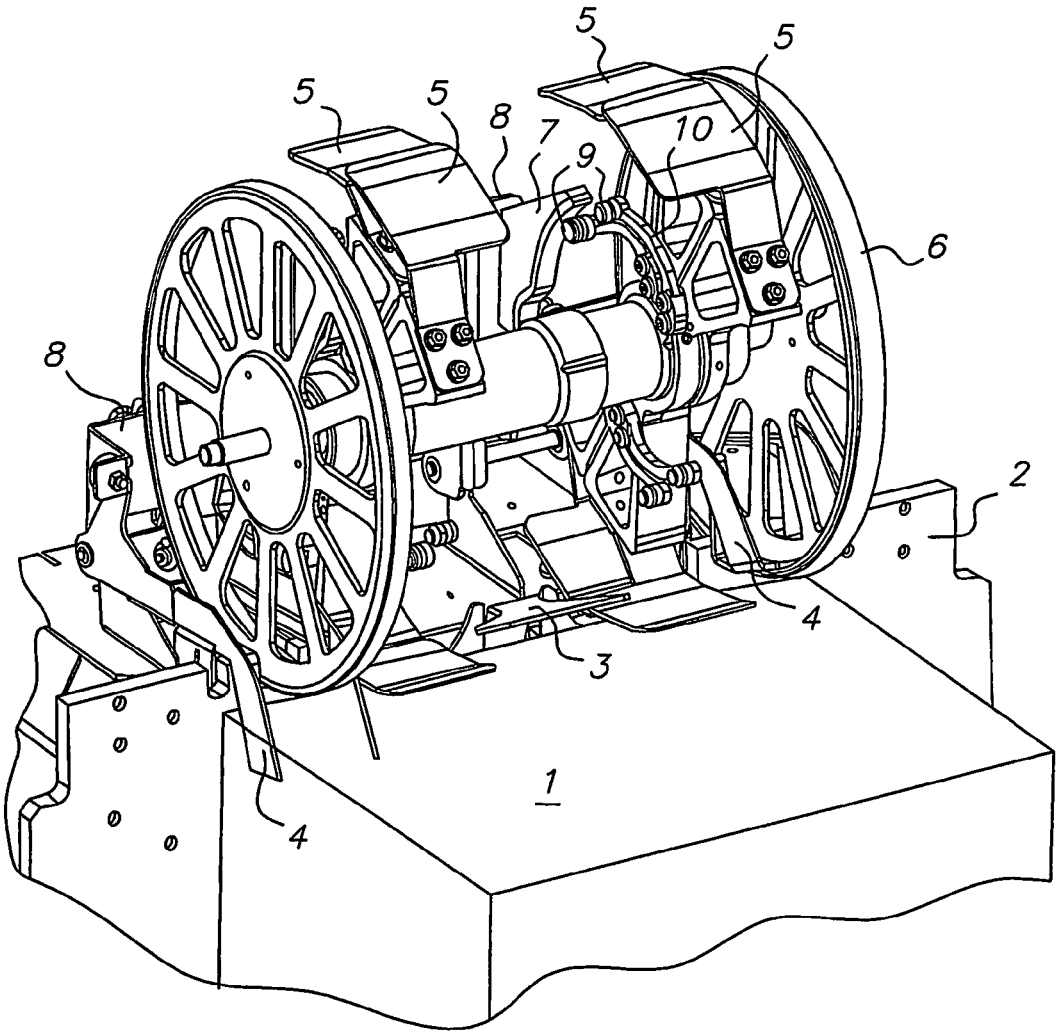
FIG. 1 is a perspective view of a device, in accordance with the invention.
Figure 2:
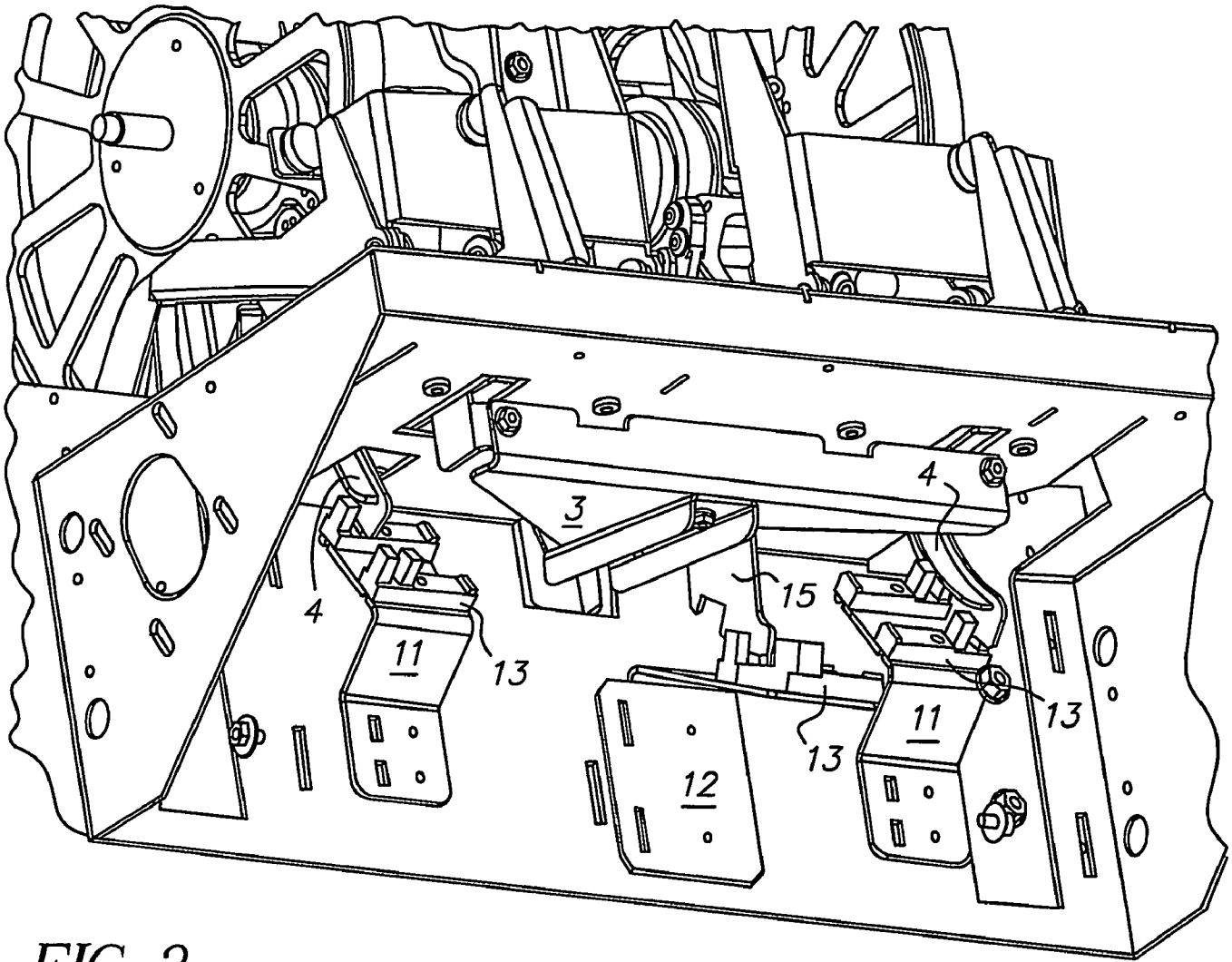
FIG. 2 is a perspective partial view of the device, in accordance with FIG. 1.

In the rotating sheet placement system (FIG. 1), in accordance with the invention, there is at least one rotating gripping element (pair 5) on at least one sheet conveyor, which, jointly with a sheet guide 6, turns a sheet to be placed in a stack by 180°, from a paper path, and conveys it to a stack edge 2. It is important thereby that after each placed sheet, the stack level is again detected, so that the placement mechanics is not blocked by a growing stack 1 and in the end, is damaged. Therefore, it is necessary to detect the new stack level and perhaps to lower a tray on which the sheets are placed.

For this reason, sensors and holding-down elements 3, 4 are needed, which can be lowered to the stack 1, after the sheet has arrived at the stack edge 2 with its front edge and is no longer pushed any further. The lifting of the holding-down elements 3, 4 is always necessary when the next sheet is conveyed to the stack edge 2 (the path for the next sheet must be released). What is important in the recognition of the stack level is that the entire width (along the stack edge 2) must be inspected so that a crushing and finally, a shifting of the sheets or even of the entire stack 1 does not occur. In addition, however, not only the topmost stack level is of interest, however, but rather also the possible lowest level, because only these two values, together, permit a statement regarding the inclined position of the stack 1. After a certain inclined position, in any case, one can expect a side sliding of the stack 1. The result is the requirement for a multi-part level detection system.

In the solution, in accordance with the invention, a three-part level detection system with three sensors and holding-down elements 3, 4 is shown. It can be arbitrarily refined, however, which means that the segmentation can be arbitrarily increased.

"Three-part" means that a holding-down element 3 is located in the middle of the rotating placement system (between the rotating sheet conveyors of the depicted exemplified embodiment), and two other holding-down elements 4 are located outside the rotating conveyors. In accordance with FIG. 1, in particular, the structure depicted by way of example is as follows:

Special triggering mechanics are required for the lifting and lowering process, which must operate as a function of the position of gripping elements 5.

So that it is possible to dispense with a separate drive for the lifting and lowering movement and the corresponding control and regulation device, which would have to ensure the synchronization of the two systems, a roller element 9 is located on the sheet conveyor or on its swivel arms, via a bearing arm 10. These roller elements 9 introduce corresponding swivel movements of the stack level detection system.

The level recognition system has, as the basic element, a carrier 8, which is supported so that it can rotate on an axis, on which the individual sensors 3, 4 are also located. A link piece 7, on which the roller elements 9 of the sheet conveyors run, is constructed on the carrier. "Run" means that the roller elements first lift the carrier or introduce a swivel movement of the carrier around the rotation axis. After a sufficient rotating movement, which results, in the end, in a sufficient lifting of the holding-down elements, this level must be held over a time distance. This is attained by a radius contour on the link piece 7. When the roller element 9 runs through this radius area, no other swivel movement of the carrier 8 is carried out, but rather only this position is held, whereas the gripping elements 5 with the roller elements 9 continue to rotate.

The radius area located on the link piece 7 must be placed in such a manner that it has, at the highest lifted position, a radius with reference to the center of the sheet conveyor. Only in this way is a persistence in the lifted position of the carrier 8 attained, whereas the sheet conveyors continue to rotate.

If the sheet to be placed comes to a standstill, with its front edge, and the operating gripping element 5 is withdrawn below the sheet behind the stack edge 2, so that the sheet can fall free onto the stack 1, then the link piece 7 is again released via the running roller element 9. The carrier 8 falls either due to its own weight or again suddenly falls back, spring-loaded, to its starting position. Finally, as will be described below, the holding-down elements are returned onto the stack 1, as quickly as possible, so that in time, before the arrival of the next sheet, the stack level detection is carried out and the tray height can be appropriately corrected.

As indicated up to now, the carrier 8 assumes, all total, two positions, a highest and a lowest position. On the way from the lowest position to the highest position, the carrier 8 must collect the individual holding-down elements 3, 4 and also move them to the highest position, so that the next sheet to be placed can move freely to the stack edge 2. The construction is done in such a way that the holding-down elements 3, 4 can assume any arbitrary stack position (proceeding from the lowest to the stack zero position), without being impaired thereby by the position of the carrier 8.

Figure 3:
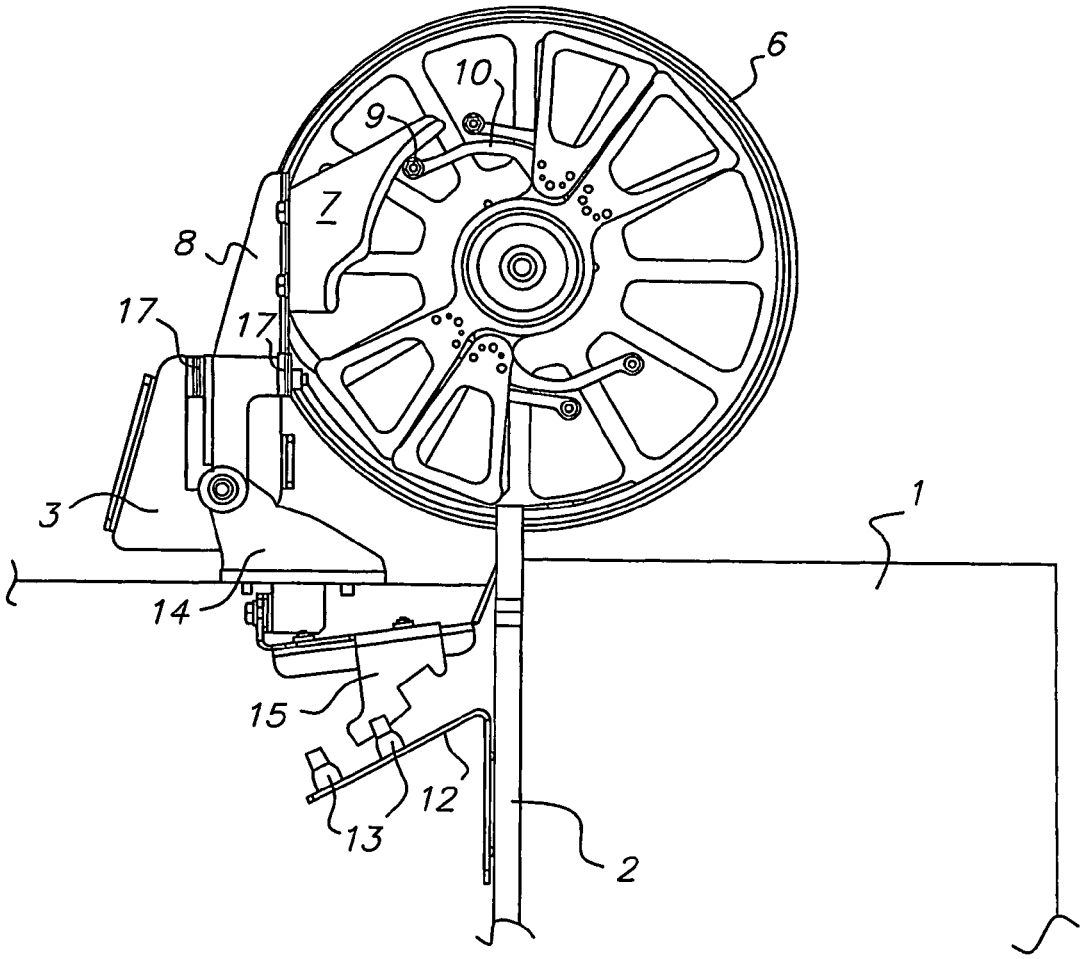
FIG. 3 is a sectional view of the device, in accordance with FIG. 1, with a sectional plane, transverse to the rotational axis of the sheet conveyor and the sheet guide.
Figure 4:
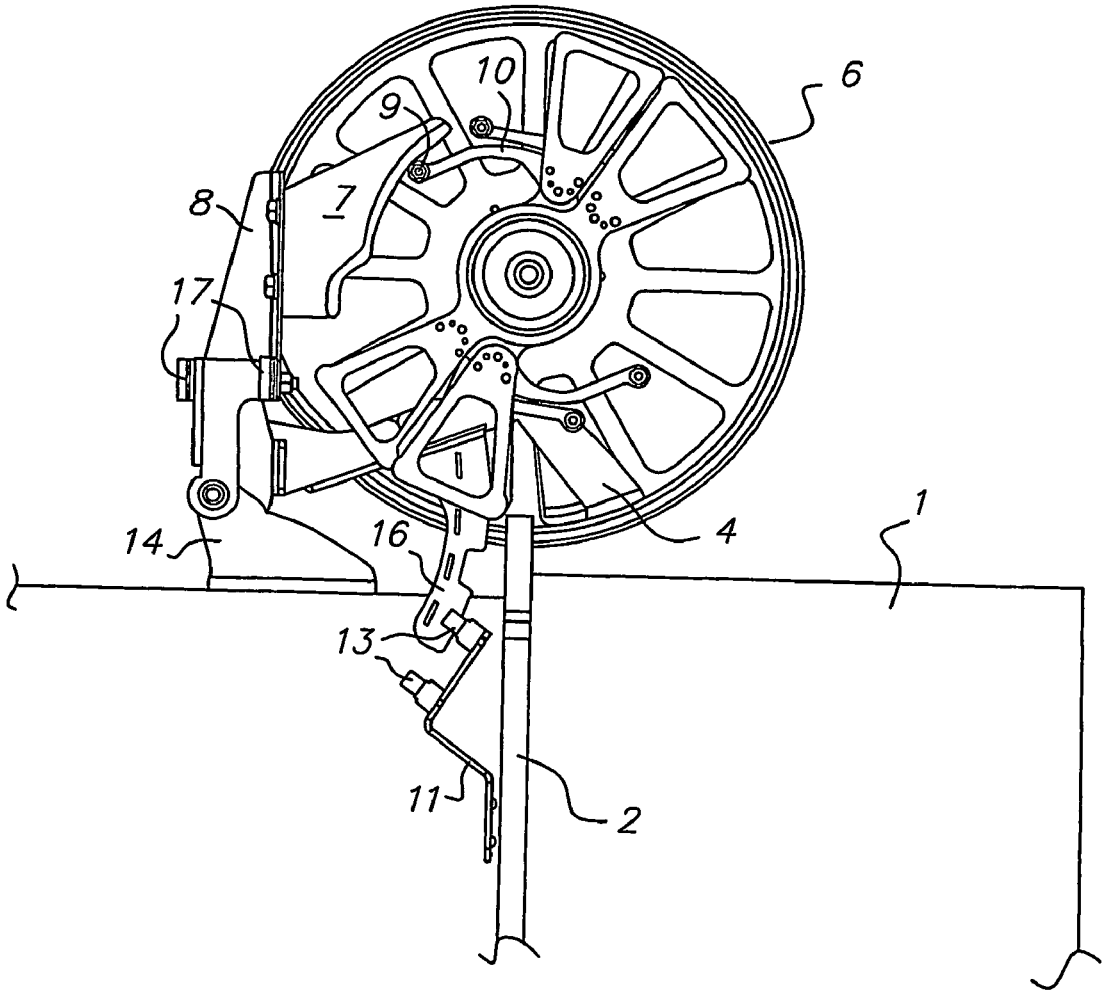
FIG. 4 is a second sectional view of the device, in accordance with FIG. 1, parallel to the section, in accordance with FIG. 3.
Figure 5:
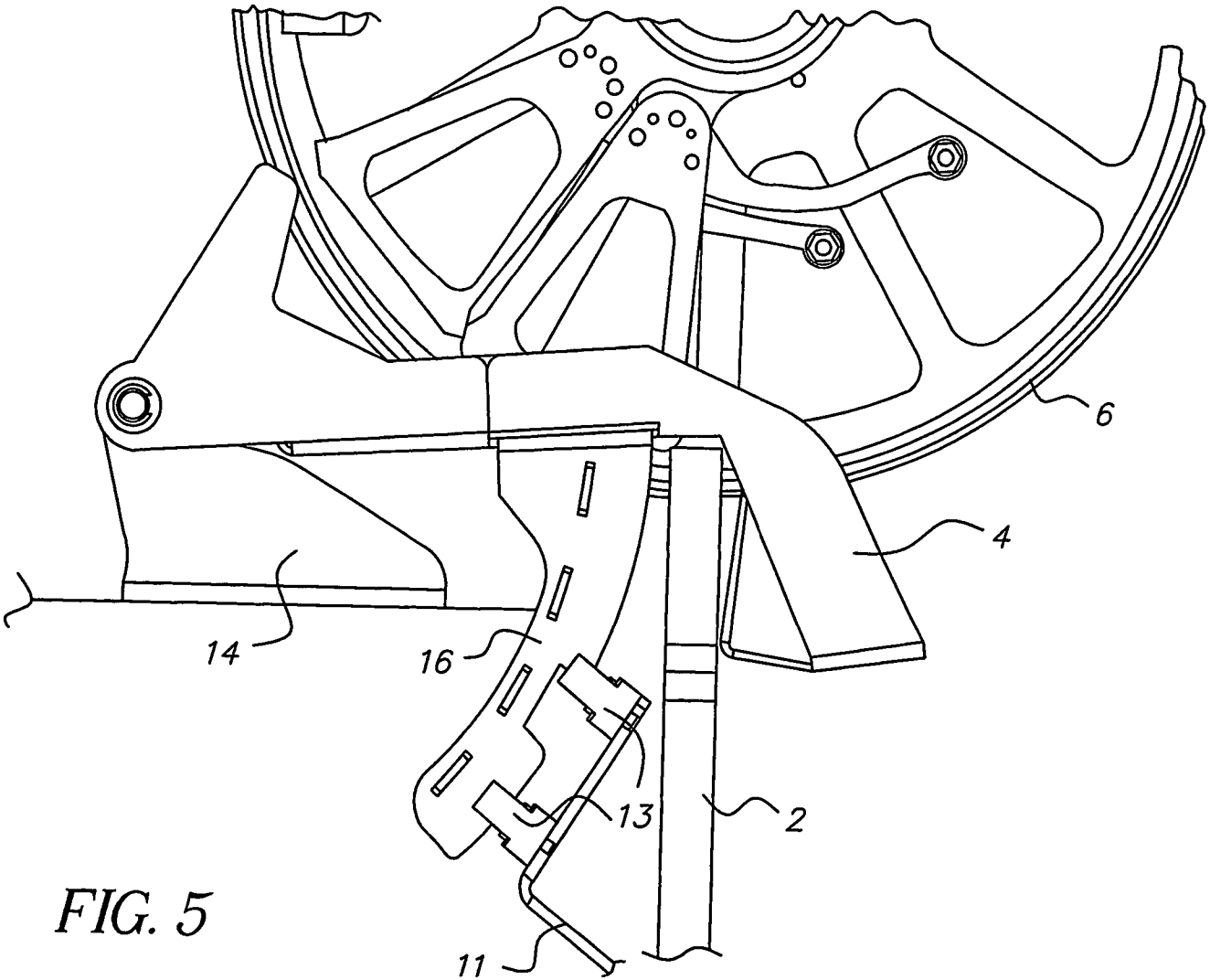
FIG. 5 is a detailed view of FIG. 4.

FIGS. 3 and 4 show that during the lifting movement, the carrier 8 collects the individual holding-down elements 3, 4 via flaps. Rubber dampers 17, which moderate the impact of the carrier 8 on the holding-down elements 3, 4 and also reduce the generation of noise, are located on the carrier flaps. The holding-down elements 3, 4 are gradually collected on the way to the highest lifted position.

In the highest position, all holding-down elements are located at a level in which they cannot hinder the next conveyed sheet. After this next sheet is placed on the stack edge, the individual holding-down elements 3, 4 are again released. With this release by the carrier 8, which falls back to its lowest position, the holding-down elements 3, 4 are also moved to their individual lowest position, specified by stack 1. At this moment when the individual holding-down elements strike the stack 1, there is no contact with the carrier 8. The holding-down elements 3, 4 thus operate, once more, independently of one another, until the next lifting process is again introduced.

FIGS. 2 through 5 show that below the holding-down elements 3, 4, forked light barriers 13 are placed on a basic frame, which detect both extreme positions of the stack 1 (zero position—highest stack position and lowest possible stack position). Per holding-down element 3, 4, therefore, two forked light barriers 13 on forked light barrier holders 11, 12 are needed.

If the zero position is exceeded by a holding-down element, the tray, on which the stack 1 is located, is correspondingly lowered; if, in addition, the possible lowest position is sensed on a holding-down element 3, 4, then the placement process is interrupted, because with a further increase in the stack, one can then expect a tilting over or a sliding away of the stack.

By this system, a low-cost solution has been found, in which, in a simple mechanical manner, several level inspections with regard to the stack can be simultaneously carried out. In the end, by only the carrier system, which is actuated by the sheet conveyers, many individual holding-down elements 3, 4 are controlled.

Moreover, advantageously, the link piece is also constructed along its guide contour with a rubber cover, so that the striking roller element 9 transfers the striking impact dampened and hereby also, the generation of noise is reduced to a minimum.

Only the carrier 8 can be provided with springs. Also the individual holding-down elements 3, 4 can be provided with springs in the direction of the lowest stack position, so that the movement returning to the stack 1 can be carried out as quickly as possible.

The function and execution of the forked light barrier inspection can be explained with the aid of FIGS. 4 through 8 in particular:

An individual switch flag 15, 16 on all three holding-down elements 3, 4, is constructed in such a way that an area and three extreme positions can be recognized. The switch flag 15, 16, has a small slit for this condition. If the holding-down element 3, 4, is located in the lifted, uppermost position (the next sheet is being placed), then the upper forked light barrier 13, is covered by the correlated switch flag 15, 16. The lower forked light barrier 13 is not interrupted.

Only if the stack zero position is reached does the contacting of the two forked, light barrier 13 change. The slit, which is located in the switch flag 15, 16, only just releases the upper forked light barrier 13; the lower forked light barrier 13 is, as before, not yet interrupted.

If the holding-down element 3, 4 is lowered furthered, then the lower forked light barrier is also interrupted. The upper forked light barrier is thereby switched free. Once again a change occurs if the maximum lowest position of the holding-down element is reached. Then, both the upper and also the lower forked light barrier are closed. By evaluating the two forked light barriers together, it is possible to make a reliable statement at to the site and the area in which the holding-down element is located. The following table shows the dependencies:

| | Upper forked light barrier | Lower forked light barrier |
|---|---|---|
| Uppermost holding-down element position; lifted position | Yes | No |
| Stack zero position | No | No |
| Position between the aero and lowest positions | No | No |
| Maximum lowest position of the stack | No | No |

The meanings are as follows:
Forked light barrier interrupted: Yes
Forked light barrier not interrupted: No The forked light barriers must be inspected with a UND linkage. Only in this way can the individual area position or extreme position be recognized.

Figure 6:
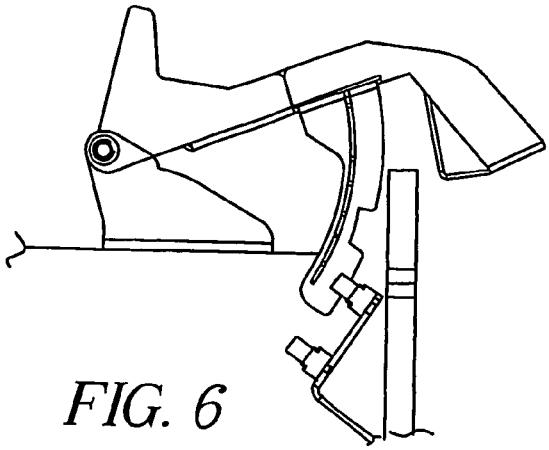
FIGS. 6 through 8 show an outside holding-down element, in accordance with FIGS. 4 and 5, in different positions.
Figure 7:
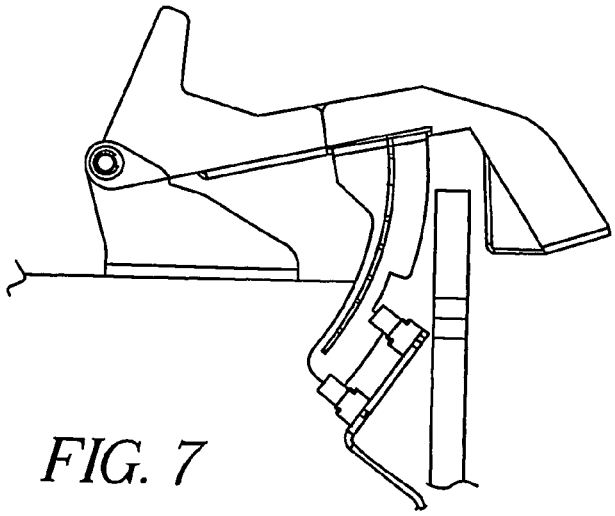
Figure 8:
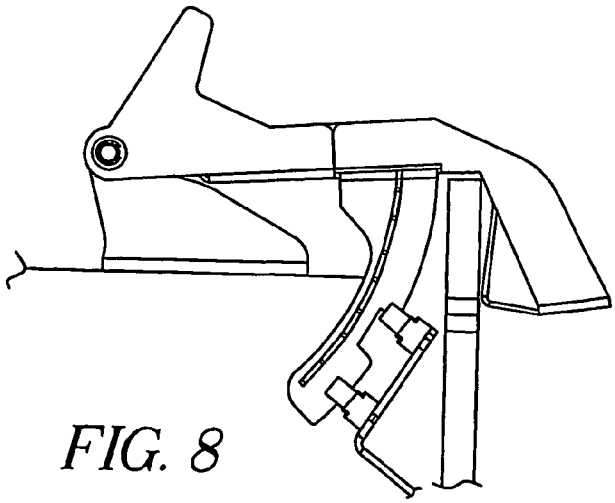

FIG. 4 shows, especially, a holding-down element 4 in the deepest possible stack position; FIGS. 6 through 8 show the three possible extreme positions of the outside holding-down element 4, namely, the lifted position, the stack zero position, and the lowest stack position.

Figure 9:
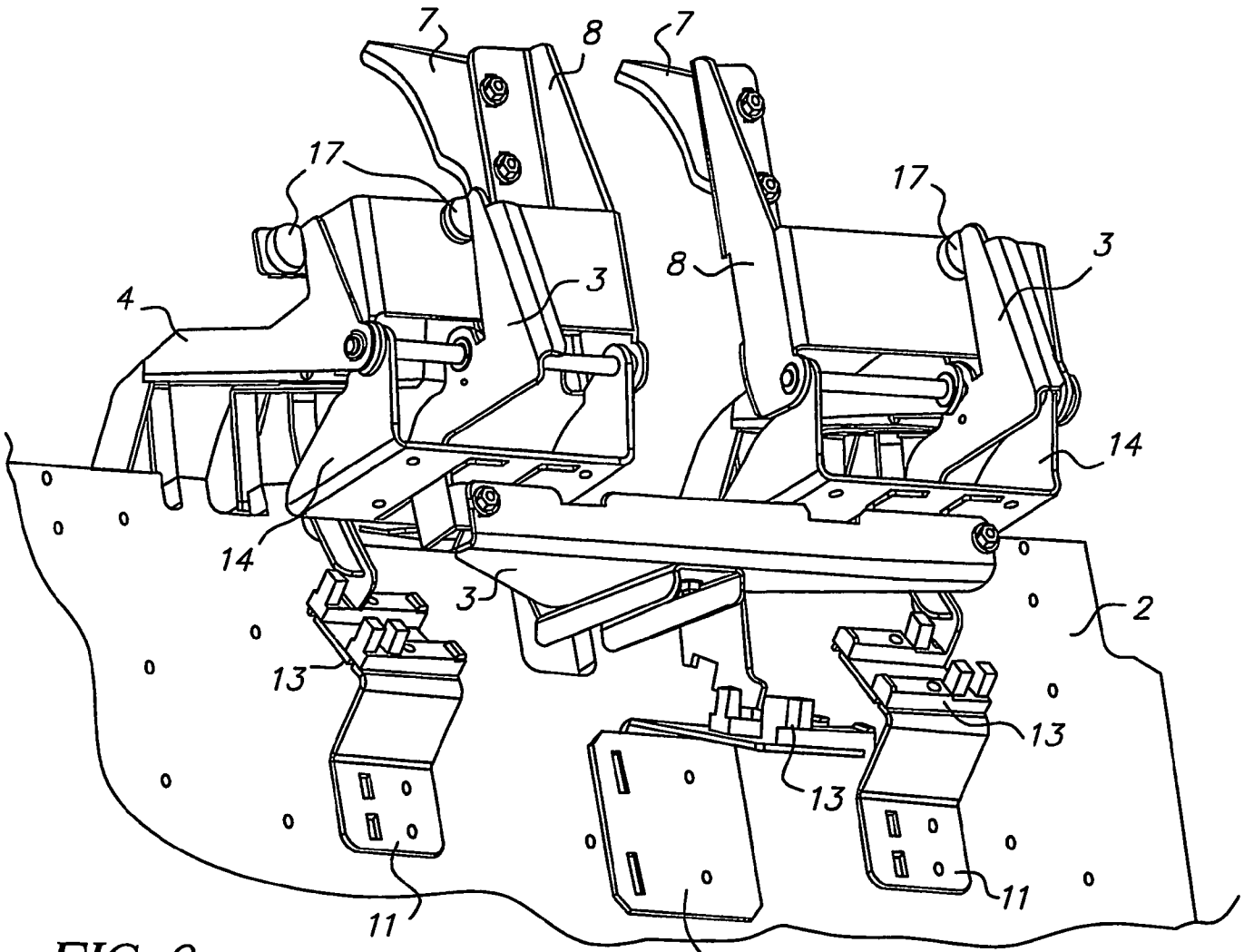
FIGS. 9 and 10 are other perspective partial views of the invention.
Figure 10:
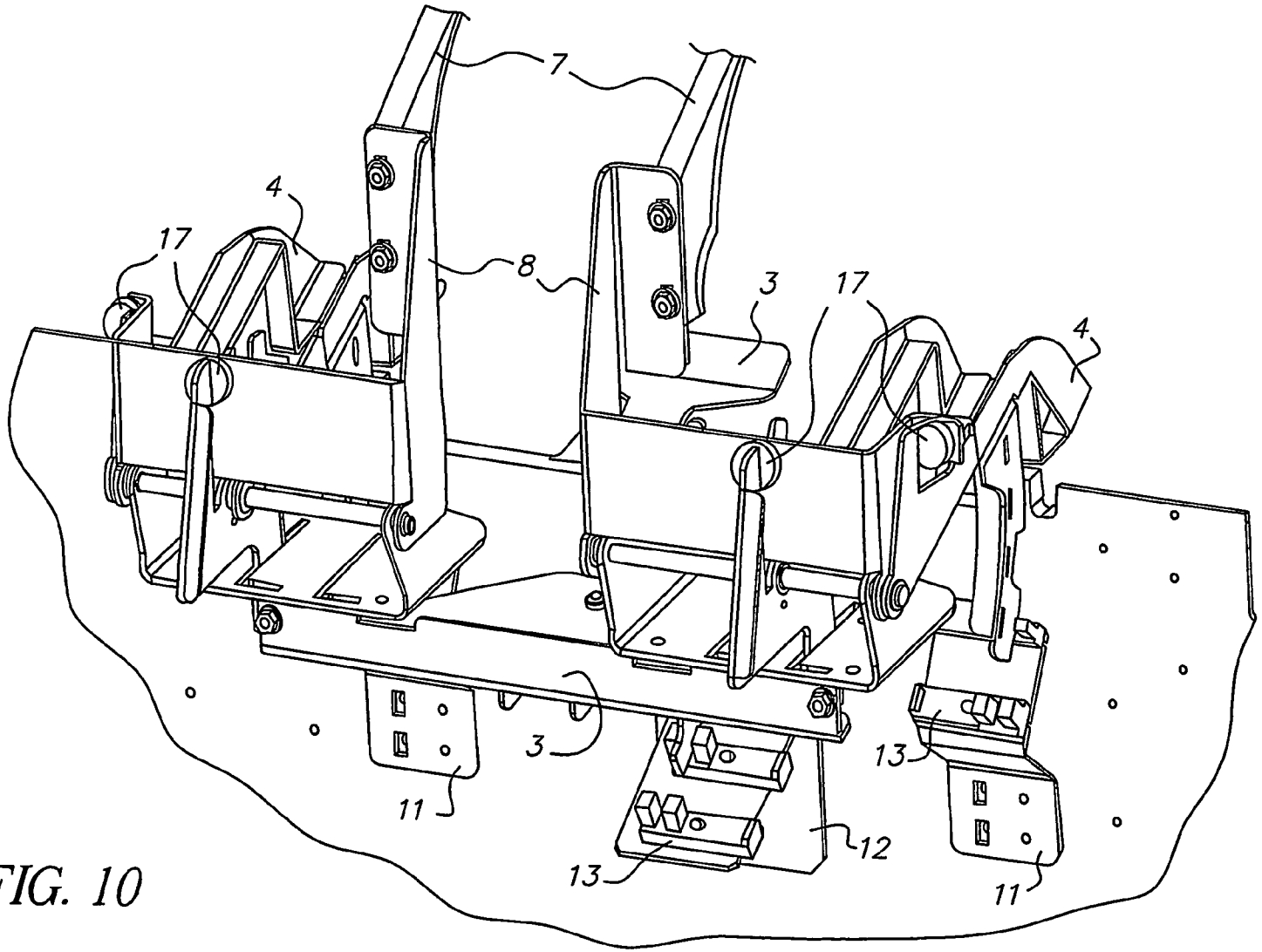

FIGS. 9 and 10 show, once more, other perspectives, in particular, the arrangements of the forked light barriers.

PARTS LIST

1. Stack
2. Stack edge
3. Holding-down element, middle
4. Holding-down element, to the right and to the left
5. Gripping elements of the sheet conveyor
6. Sheet guides
7. Link piece
8. Carrier
9. Movement-triggering roller elements
10. Bearing arms (steering elements)
11. Forked light barrier holder for outside holding-down elements -continued

| PARTS LIST |
|---|
| 12. Forked light barrier holder for middle holding-down element |
| 13. Forked light barriers |
| 14. Holder and rotating point for the carrier and the holding-down elements |
| 15. Switch flag for the triggering function of the forked light barriers on the middle holding-down element |
| 16. Switch flag for the triggering function of the forked light barriers on the outside holding-down elements |
| 17. Cushion |

The invention claimed is:

1. A device for the placement of sheets for a printer, including at least one rotating drivable sheet conveyor, which is provided to accept or grip a front edge of a sheet and for the placement of the sheet on a stack of sheets after traversing a rotation path, and a sensor device for the detection of the attained stack height and the attained stack level, which has a sensor, which simultaneously functions as the holding-down element for the stack, which is lifted, mechanically controlled, from the stack, for the release of the stack, so as to place the next sheet on the stack; said device characterized in that;

at least two sheet conveyors are provided in such a way that these several sheet conveyors can rotate around a common axis-independently of one another, and thus one of these sheet conveyors is ready to accept or detect the next sheet, if another one of these sheet conveyors is still occupied with the transport or the placement of a preceding sheet and that the sensor is coupled mechanically with several of these sheet conveyors.

2. The device according to claim 1, characterized in that a sheet guide, operating together with the sheet conveyor, is provided, wherein the sheet guide with a jacket surface serving as a placement for the sheet essentially specifies a curvature path for the sheet to be conveyed and each sheet conveyor has at least one gripping element to grip the accepted front edge of the sheet, in such a way that the front edge of the sheet is gripped and conveyed between one of these gripping elements of a sheet conveyor and the jacket surface of the sheet guide, wherein the sensor is mechanically coupled with all sheet conveyors and/or with the sheet guide.

3. The device according to claim 2, characterized in that the sheet guide is essentially constructed in the form of a disk or a wheel.

4. The device according to claim 2, characterized in that each sheet conveyor is essentially constructed as a two-arm swivel beam, which has a gripping element in the area of its two free ends, pointing outwards radially.

5. The device according to claim 4, characterized in that several of the sheet conveyors and the sheet guide are doubly provided and are located on the common axis, with mirror symmetry with respect to one another, in such a way that all sheet conveyors are placed between the two sheet guides, so that a front edge of a sheet can be gripped jointly, in its course parallel to the common axis of the sheet conveyors and the sheet guides, by two of the, all total, at least four sheet conveyors and two sheet guides.

6. The device according to claim 5, characterized in that the sensor is coupled, by guide links, with the majority of the sheet conveyers.

7. The device according to claim 6, characterized in that the sensor has at least one bearing arm, which carries at least one roller element, guided and rolling on a guide link.

8. The device for the placement of sheets for a printer according to claim 1, including several of these sensors, which are arranged, distributed, over the stack width, are provided, all of which are coupled mechanically with at least one sheet conveyor.

9. The device according to claim 8, characterized in that three sensors are provided, of which one is placed in the middle of the stack and the other two, at a distance to one and the other side of the middle sensor.

10. The device according to claim 8, characterized in that to detect the level position of at least one sensor, at least one sensor element is provided.

11. The device according to claim 10, characterized in that the sensor element is a forked light barrier.

12. The device according to claim 10, characterized in that three marked level positions of the sensor can be detected by the sensor element.

13. The device according to claim 12, characterized in that the lifted position, the stack zero position, and the lowest stack position of the sensor can be detected.

14. The device according to claim 13, characterized in that the marked level positions are recognizable by a switch flag, coupled with the sensor.

* * * * *